US006076867A

United States Patent [19]

Dollman et al.

[11] Patent Number: 6,076,867

[45] Date of Patent: Jun. 20, 2000

[54] SAFETY LATCH

[75] Inventors: James M. Dollman, Toledo; Joseph A. Dollman, Maumee, both of Ohio

[73] Assignee: Dollman Technical Services, Inc., Whitehouse, Ohio

[21] Appl. No.: 09/161,507

[22] Filed: Sep. 28, 1998

[51] Int. Cl.[7] ..... E05C 1/12

[52] U.S. Cl. ..... 292/174; 292/168; 292/DIG. 41

[58] Field of Search ..... 292/41, 168, 174, 292/37, 34, 165, 166, 170, 171, 140, 346, DIG. 41

[56] References Cited

U.S. PATENT DOCUMENTS

| | | | |
|---|---|---|---|
| 336,374 | 2/1886 | Bayrhoffer | 292/168 |
| 357,116 | 2/1887 | Coultaus | 292/174 |
| 426,389 | 4/1890 | Lacey | 292/171 |
| 705,282 | 7/1902 | Nelson | 292/41 |
| 784,057 | 3/1905 | Lovelace | 292/171 |
| 1,306,386 | 6/1919 | Malone et al. | 292/171 |
| 1,516,628 | 11/1924 | Blackwell . | |
| 1,615,120 | 1/1927 | Fischer . | |
| 1,720,492 | 7/1929 | Pollack | 292/171 X |
| 1,910,102 | 5/1933 | Godfrey . | |
| 2,036,154 | 3/1936 | Littledale | 292/174 X |
| 2,145,968 | 2/1939 | Bozarth | 292/174 X |
| 2,186,666 | 1/1940 | Cereda | 292/174 X |
| 2,499,107 | 2/1950 | Miller . | |
| 2,644,705 | 7/1953 | Hagstrom . | |
| 2,650,123 | 8/1953 | Hopgood . | |
| 4,130,310 | 12/1978 | Kessie | 292/DIG. 41 X |
| 4,474,393 | 10/1984 | Kimura | 292/174 |
| 4,777,810 | 10/1988 | Webster | 292/174 X |

*Primary Examiner*—B. Dayoan
*Assistant Examiner*—Gary Estremsky
*Attorney, Agent, or Firm*—Oliff & Berridge, PLC; Edward P. Walker

[57] ABSTRACT

A safety latch for securing doors, windows and the like includes a plunger slidably received within a housing and movable between extended and retracted positions. A first end of the plunger is freely available for engagement with a hole, recess, strikeplate, or the like externally of the housing, and a second end of the plunger within the housing includes a cam member. A retracting member is interconnected with the plunger through the use of an intermediate member located between and connected at its opposite ends to the plunger and the retracting member. Either a first end of the intermediate member or the retracting member includes a cam follower engageable with the cam member included on the plunger. When a force is applied to the retracting member to pull the plunger into the housing from the extended position toward the retracted position, the plunger is freely movable within the housing to the retracted position. However, when a force is applied in an attempt to push the plunger into the housing from the extended position toward the retracted position, the cam member acts against the cam follower to cause a locking member on the intermediate member to engage with an opening in the housing to prevent movement of the plunger to the retracted position.

28 Claims, 10 Drawing Sheets

SAFETY LATCH

FIELD OF THE INVENTION

The invention pertains to latches for doors, windows, access panels, trunks, tail gates, handicap equipment, and the like.

BACKGROUND OF THE INVENTION

There are numerous devices that require latches to secure such things as doors, windows and access panels, one example being a shipping container. There are also numerous latches available for such applications. However, they are susceptible to becoming inadvertently or undesirably opened due to jarring impacts, vibrations, or forced entry.

A latching mechanism developed in part to overcome the problem of forced entry is disclosed in U.S. Pat. No. 2,644,705. That latching mechanism includes a dead latching dog for preventing someone from prying open an inclined-face latch bolt used in conjunction with a dead latch in a door knob assembly. While this latching mechanism may provide some degree of security in the particular environment for which it was designed, it does not provide completely sufficient security, it is extremely complicated and costly, and it has little or no applicability to other situations.

Other examples of latch and bolt mechanisms are disclosed in U.S. Pat. Nos. 2,650,123; 1,516,628; 1,615,120; 1,910,102; and 2,499,107. These disclosed mechanisms likewise are unduly complicated, insufficiently secure and/or limited in their applicability.

Thus, there remains a need for a secure safety latch of simplified and cost effective construction that has broad applicability.

SUMMARY OF THE INVENTION

It is accordingly an object of the present invention to provide a safety latch that preferably has broad applicability to a variety of devices.

It is another object of the present invention to provide a safety latch that is secure but yet preferably has a relatively simple and cost-effective construction.

To achieve these and other objects, and to overcome the shortcomings of existing latches discussed above, a preferred embodiment of the safety latch of the present invention includes a plunger movable between extended and retracted positions, a first end of the plunger being freely available for engagement; a cam member interconnected with the plunger; a cam follower engageable with the cam member; a locking member interconnected with the cam follower; and a retracting member interconnected with the plunger. The plunger is freely movable from the extended position to the retracted position when a force is applied to the retracting member to pull the plunger toward the retracted position. However, when a force is applied in an attempt to push the plunger from the extended position toward the retracted position, the locking member prevents movement of the plunger to the retracted position.

In accordance with other aspects of the present invention, a second end of the plunger preferably includes the cam member and/or the cam member preferably acts against the cam follower to cause the locking member to prevent movement of the plunger to the retracted position when the force is applied in an attempt to push the plunger. The safety latch of the present invention also preferably includes a spring for biasing the plunger into the extended position, the retracting member acting against the biasing spring when a pulling force is applied to the retracting member. The cam member and cam follower may include inclined surfaces, a cylindrical-shaped member and inclined surface, a cylindrical-shaped pin and inclined slot, or other alternative structures.

The locking member and cam follower may be positioned on an intermediate member located between the plunger and the retracting member. Alternatively, the locking member and the cam member may be positioned on the intermediate member, and the cam follower may be located on the retracting member. The plunger and the retracting member preferably are connected to opposite ends of the intermediate member, by means of a protruding coupler/receiving groove arrangement, a cylindrical pin/hole/inclined slot arrangement, or other alternative arrangements. The intermediate member may be substantially Z-shaped, substantially L-shaped, or otherwise.

The retracting member may be equipped so that force may be applied to the retracting member to pull the plunger toward the retracted position by means of an in-line mechanism. Alternatively, force may be applied to the retracting member in other ways, such as by means of a rotational mechanism.

The safety latch may also include a housing. In this case, the plunger is slidably received within a first opening in the housing so that a first end of the plunger is freely available for engagement externally of the housing. The retracting member preferably extends through a second opening in the housing. The plunger is freely movable within the housing to the retracted position when a force is applied to the retracting member to pull the plunger into the housing toward the retracted position, whereas when a force is applied in an attempt to push the plunger into the housing toward the retracted position, the locking member engages with the housing to prevent movement of the plunger to the retracted position.

These and other objects, features and advantages of the present invention will be understood more clearly from the following detailed description and accompanying drawings.

BRIEF DESCRIPTION OF THE DRAWINGS

The preferred embodiments are described with reference to the drawings in which.

DETAILED DESCRIPTION OF THE PREFERRED EMBODIMENTS

Figure 1A:
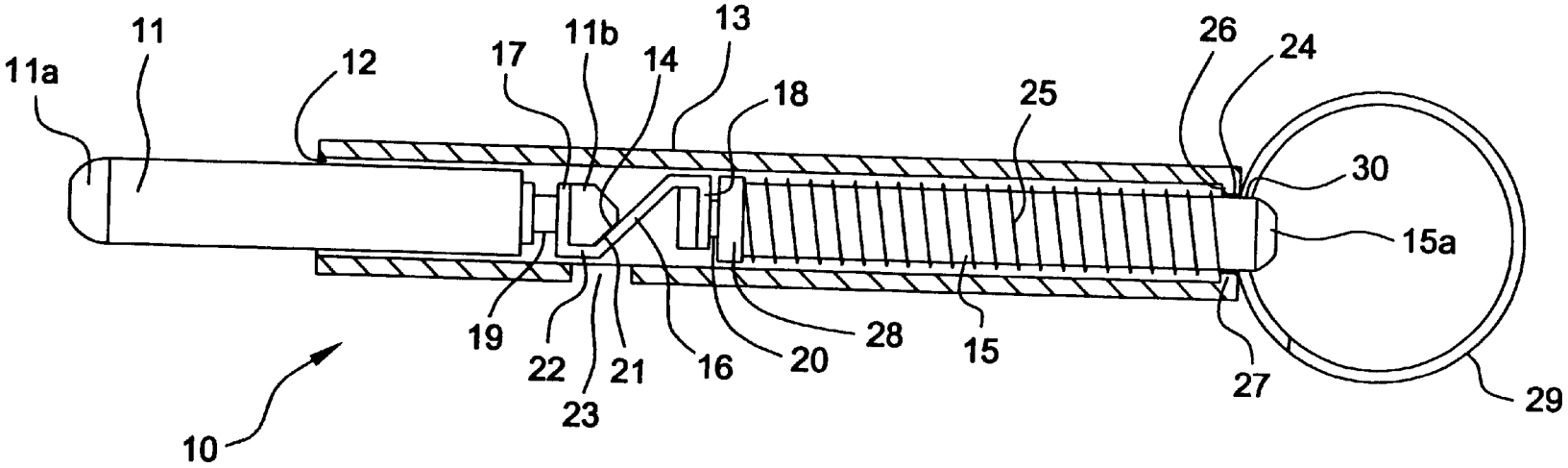
FIGS. 1A, 1B and 1C are views partially in cross section of a safety latch according to a first embodiment of the present invention.
Figure 1B:
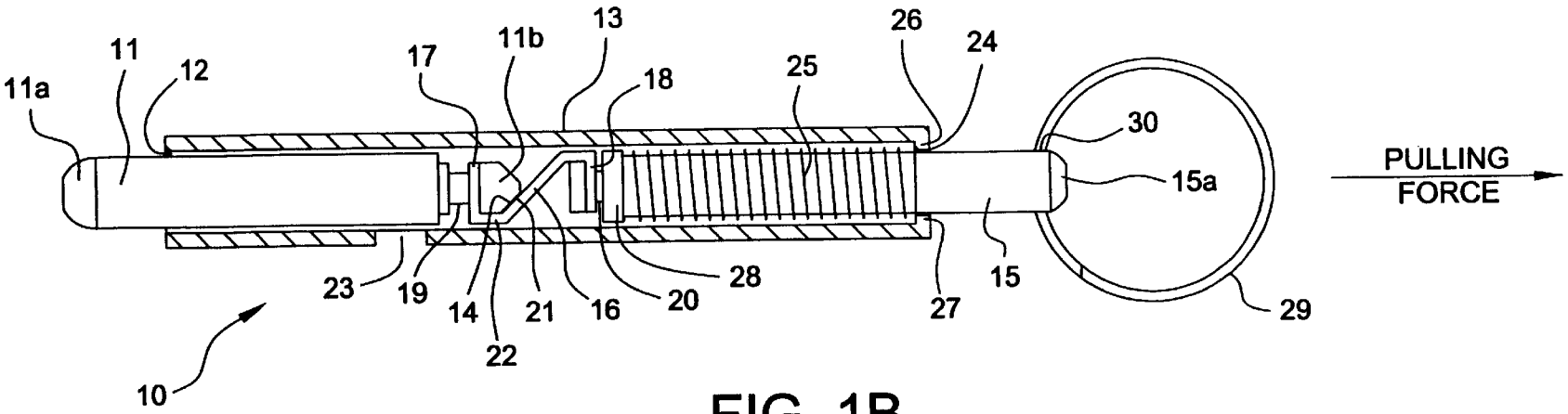
Figure 1C:
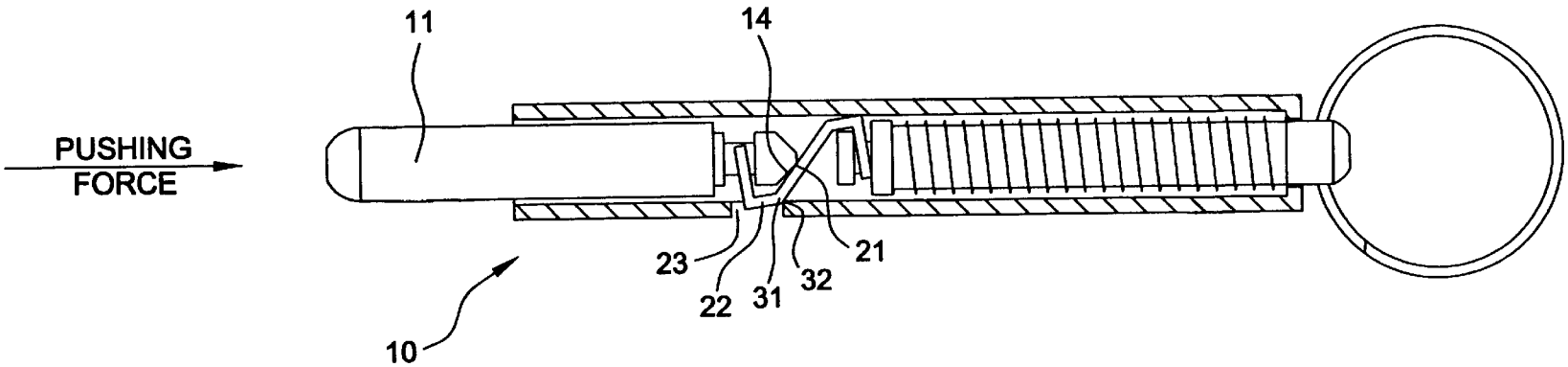

Referring to FIGS. 1A through 1C, a safety latch 10 according to a first embodiment of the present invention is shown. Safety latch 10 includes a plunger or bolt 11 that extends from a first opening 12 of a housing 13, opening 12 extending into and forming a hollow chamber through the housing. The plunger, housing and housing opening may be of various alternative shapes and sizes, but preferably constitute a cylindrical-shaped plunger extending through a square opening of a housing that has a square cross section.

Figure 6:
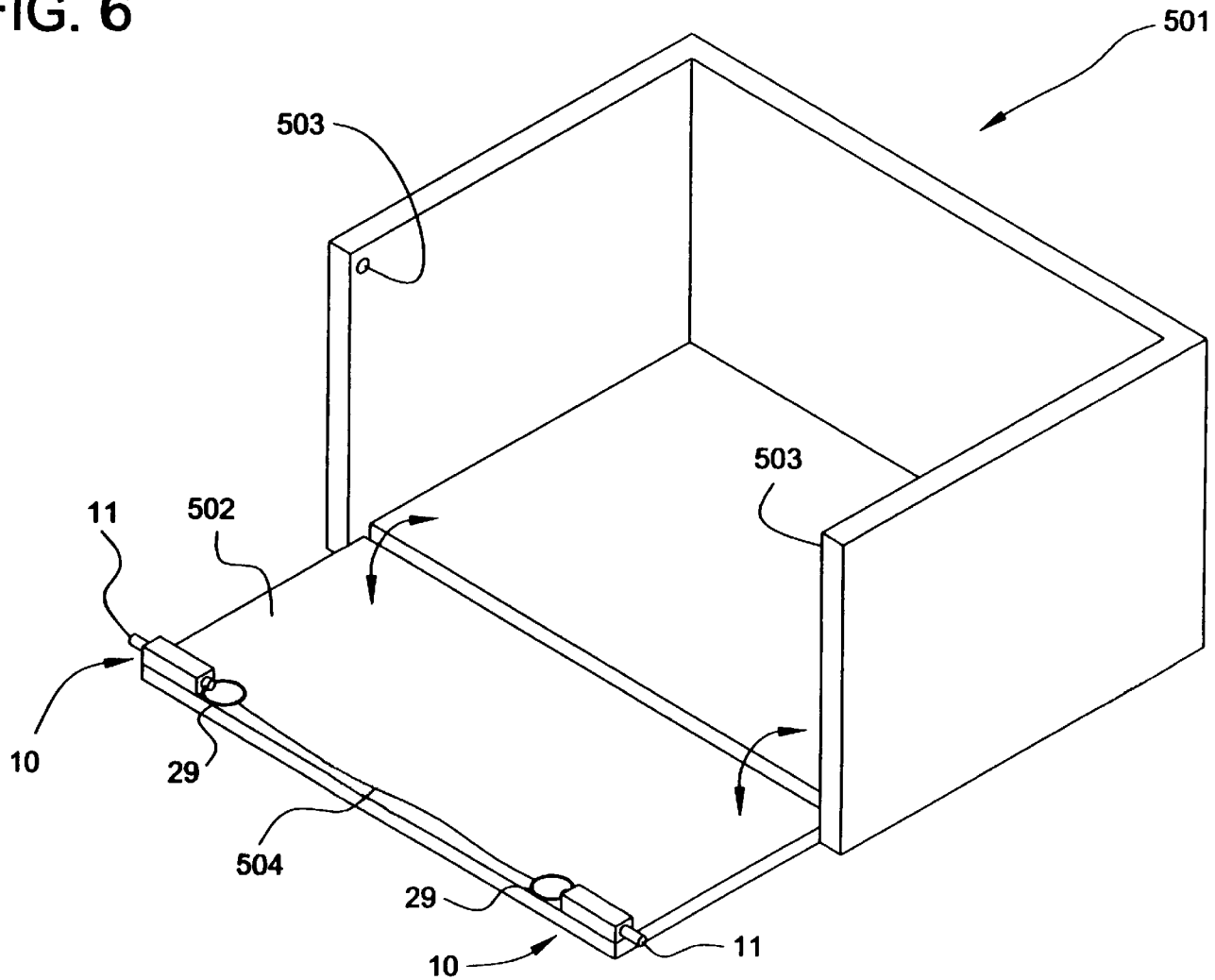
FIG. 6 is a perspective view of one possible application of the safety latch of the present invention on a shipping container.

The plunger 11 is slidably movable within the housing between extended and retracted positions. A first end 11*a* of plunger 11 is freely available for engagement with a hole, recess, strikeplate, etc. on a device such as an access panel frame of a shipping container as illustrated in FIG. 6 and discussed more fully below. A second end 11*b* of plunger 11 includes a cam member 14, unitarily formed on the end of the plunger in this embodiment as an inclined surface in the shape of a cone.

The safety latch of this embodiment also includes a retracting member 15 interconnected with the plunger 11 by means of a substantially Z-shaped intermediate member 16, whose overall cross section preferably is shaped the same as but is slightly smaller than that of the opening 12 of the housing 13. Intermediate member 16 includes U-shaped protruding couplers 17, 18 at its respective ends engaged with annular grooves 19, 20 unitarily formed adjacent the inwardly confronting ends of plunger 11 and retracting member 15, respectively. Intermediate member 16 also includes an inclined surface 21 serving as a cam follower for engagement with cam member 14. Intermediate member 16 further includes a locking member 22 for engagement with an opening 23 in the side of the housing 13.

Retracting member 15 extends through yet another opening 24 in the housing 13 at the opposite end of the housing from opening 12. Retracting member 15 and opening 24 may be of various alternative shapes, but preferably constitute a cylindrical-shaped retracting member extending through a circular hole 24. A coil spring 25 is situated between and acts against shoulders 26, 27 on the housing 13 and an abutting portion 28 unitarily formed on retracting member 15 to normally bias plunger 11 into a position in which it extends from housing 13. A ring 29 is provided through a hole 30 in the externally protruding end 15*a* of retracting member 15. Ring 29 provides a vehicle for applying a pulling force to the safety latch and also serves to prevent the safety latch components from falling out of the housing through opening 12.

The operation of the safety latch of the first embodiment is hereby described with reference to FIGS. 1A through 1C. FIG. 1A illustrates safety latch 10 when plunger 11 is in a completely or sufficiently extended position, i.e., a position into which plunger 11 is normally biased by spring 25 before any force is applied to retract the plunger, and a position of the plunger when it is properly engaged with any corresponding hole, recess, strikeplate, etc. In an extended position of the plunger, locking member 22 is offset toward the plunger side of opening 23 by at least a small amount as shown in FIG. 1A, or alternatively is situated over opening 23, and in either case is unengaged with opening 23. When a force is applied to the retracting member 15 as shown in FIG. 1B to pull the plunger from its extended position into the housing against the force of spring 25 toward a retracted position—i.e., a position in which the plunger is completely retracted into the housing or at least sufficiently retracted into the housing to disengage the plunger from any corresponding hole, recess, strikeplate, etc. with which it may otherwise be engaged when it is in its extended position—locking member 22 moves past and remains unengaged with opening 23 so that plunger 11 is able to freely move within the housing to the retracted position. On the other hand, when a force is applied in an attempt to push plunger 11 from its extended position into the housing toward a retracted position as shown in FIG. 1C, cam member 14 acts against the inclined surface of cam follower 21 positively causing locking member 22 to protrude into opening 23 so that a portion 31 on intermediate member 16 engages with an edge 32 on housing 13, thereby limiting movement of the plunger and preventing it from reaching the retracted position. In this way, it is possible to pull plunger 11 out of any hole, recess or strikeplate with which it is engaged so as to open any door, access panel, etc. with which the safety latch is utilized. On the other hand, disengagement of plunger 11 by means of a pushing force is precluded, whether that pushing force is the result of inadvertent jarring impacts, attempts at forced entry, or otherwise.

Figure 2A:
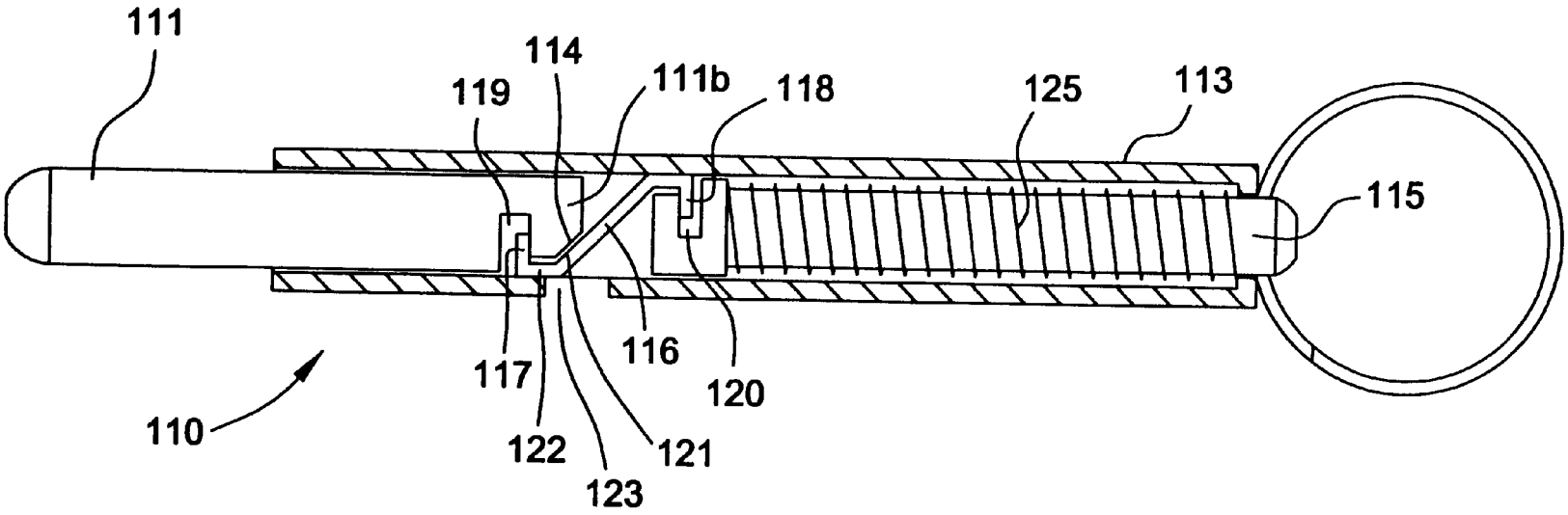
FIGS. 2A, 2B and 2C are views partially in cross section of a safety latch according to a second embodiment of the present invention.
Figure 2B:
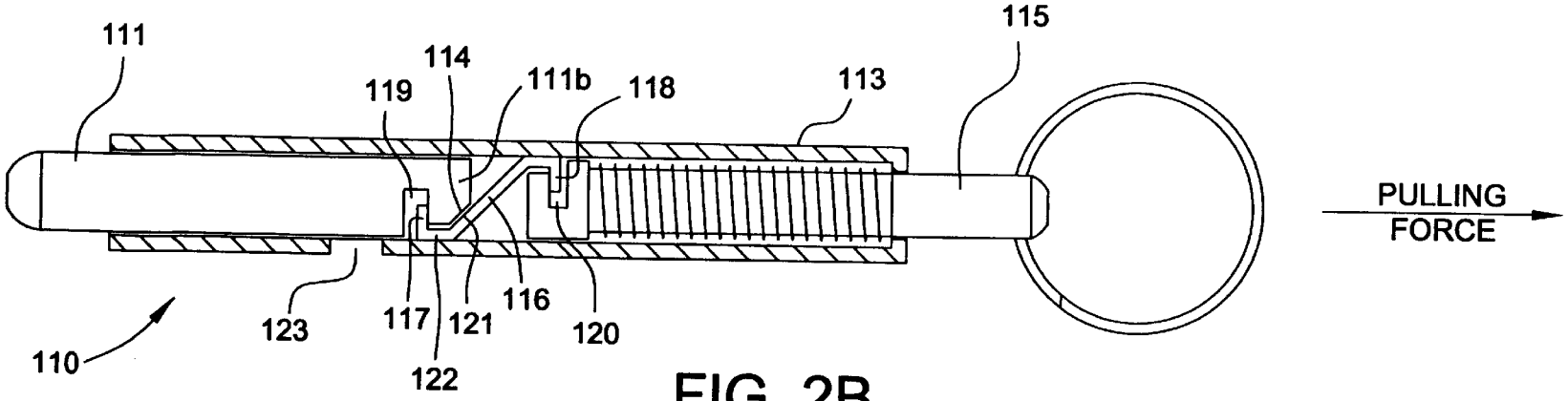
Figure 2C:
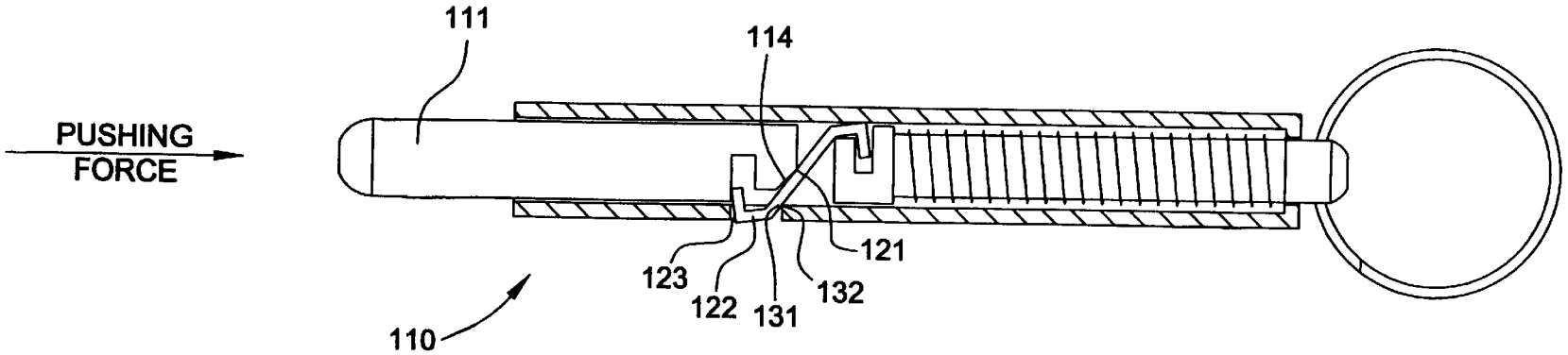

A safety latch 110 according to a second embodiment of the present invention is depicted in FIGS. 2A through 2C. This embodiment is the same as or similar to the first embodiment in most respects, and it is therefore unnecessary to repeat the description of the components that are the same as or similar to those of the first embodiment. The second embodiment differs from the first embodiment in terms of the specific configurations and interconnections of the intermediate member and the confronting internal ends of the plunger and the retracting member. As shown in FIG. 2A, end 111*b* of plunger 111 is formed with a single inclined surface serving as cam member 114, rather than being cone-shaped as in the case of cam member 14 of the first embodiment. Intermediate member 116 includes an inclined surface cam follower 121, and a locking member 122 engageable with an opening 123 in the side of housing 113. Moreover, straight-edged protruding couplers 117 and 118 of intermediate member 116 are received into shallow grooves or recesses 119 and 120 formed in plunger 111 and retracting member 115, respectively, in lieu of the U-shaped coupler/annular groove arrangement of the first embodiment. This arrangement of the second embodiment is particularly useful in the event that the confronting inner ends of the plunger and retracting member are square or rectangular in cross section instead of cylindrical-shaped as in the first embodiment.

The operation of safety latch 110 of the second embodiment is similar to the operation of safety latch 10 of the first embodiment, and is hereby described with reference to FIGS. 2A through 2C. FIG. 2A illustrates safety latch 110 when plunger 111 is in an extended position and locking member 122 is situated over or offset to the plunger side of and is unengaged with opening 123. When a force is applied to retracting member 115 as shown in FIG. 2B to pull plunger 111 from its extended position into housing 113 against the force of the spring 125 toward a retracted position, locking member 122 moves past and remains unengaged with housing opening 123 so that plunger 111 is able to freely move within the housing to the retracted position. On the other hand, when a force is applied in an attempt to push plunger 111 from its extended position into the housing toward a retracted position as shown in FIG. 2C, cam member 114 acts against the inclined surface of cam follower 121 positively causing locking member 122 to protrude into housing opening 123 so that portion 131 on intermediate member 116 engages with an edge 132 on housing 113, thereby limiting movement of plunger 111 and preventing it from reaching the retracted position.

Figure 3A:
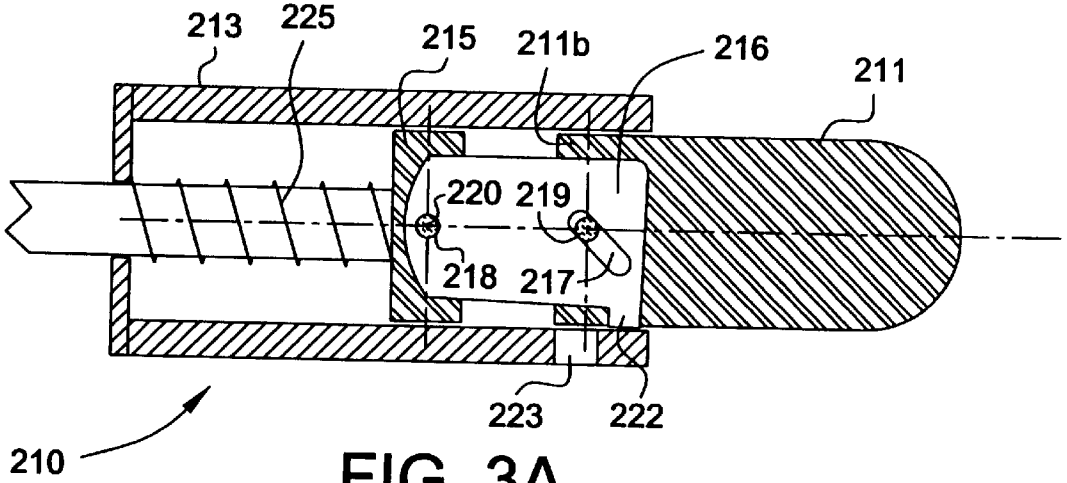
FIGS. 3A, 3B, 3C and 3D are views partially in cross section of a safety latch according to a third embodiment of the present invention.
Figure 3B:
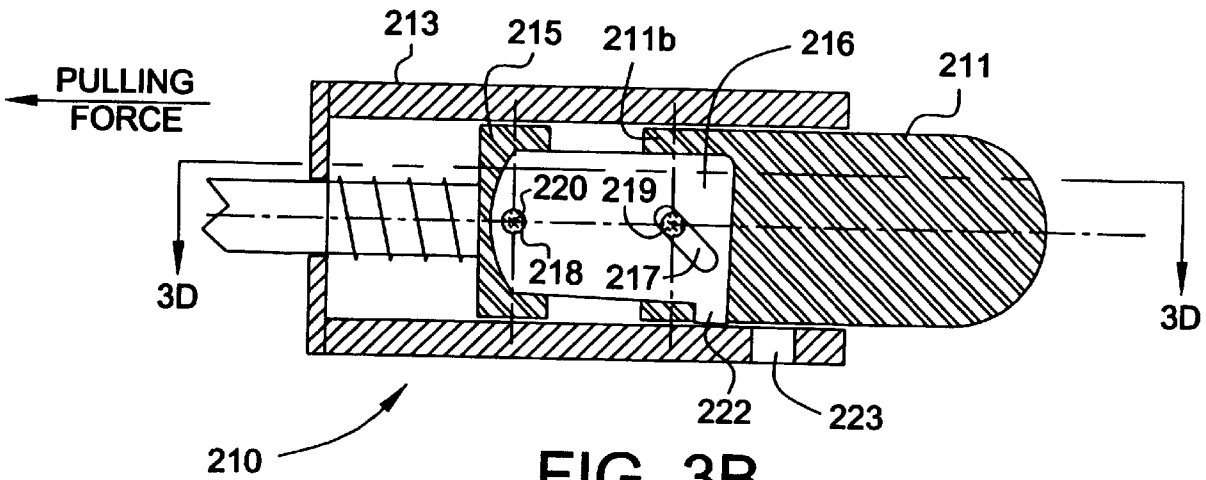
Figure 3C:
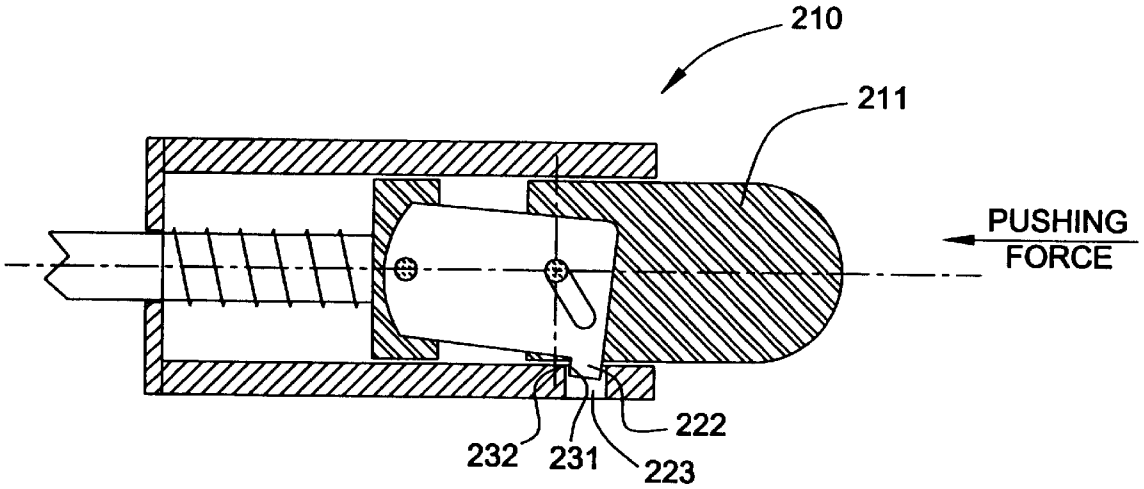
Figure 3D:
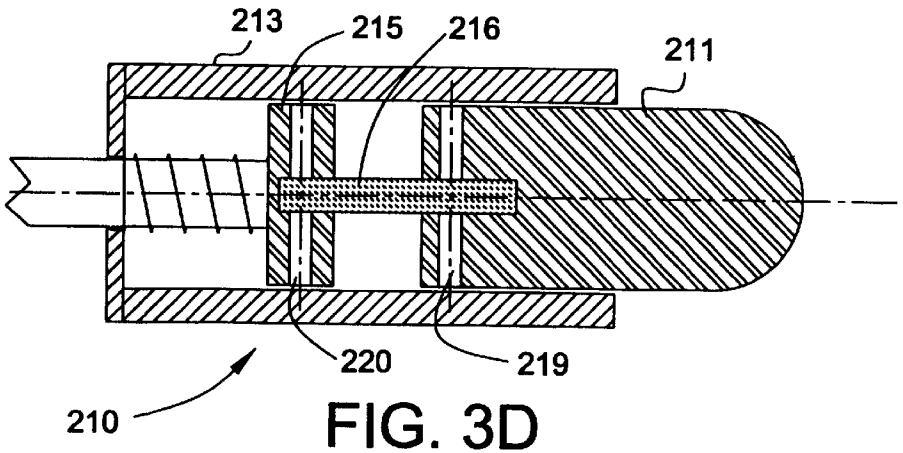

FIGS. 3A through 3D depict a safety latch 210 according to a third embodiment of the present invention. Again, many of the components of the third embodiment are the same as or similar to those of the first and second embodiments, and it is therefore unnecessary to repeat a description of those like components here. The third embodiment differs from the first and second embodiments in terms of the specific configurations and interconnections of the intermediate member and the confronting internal ends of the plunger and the retracting member. In this embodiment, as shown in FIG. 3A, a substantially L-shaped intermediate member 216 is pivotally connected to retracting member 215 by means of a cylindrical pin 220 on the retracting member extending through a hole 218 in the intermediate member. Intermediate member 216 is slidingly connected to plunger 211 by means of a cylindrical pin 219 unitarily formed on or otherwise fixedly provided on inner end 211*b* of the plunger 211 and extending through an inclined slot 217 on the intermediate member. Plunger 211 and retracting member 215 may be machined for positioning of intermediate member 216 centrally within housing 213 as shown in FIG. 3D, or they may be machined for positioning of intermediate member 216 adjacent one of the walls of housing 213.

In this third embodiment, cylindrical pin 219 serves as the cam member on the inner end 211*b* of plunger 211, and inclined slot 217 serves as the corresponding cam follower on intermediate member 216. Intermediate member 216 also includes a locking member 222 engageable with an opening 223 in the side of housing 213.

The operation of this third safety latch embodiment is hereby described with reference to FIGS. 3A through 3C. FIG. 3A illustrates safety latch 210 when plunger 211 is in an extended position and locking member 222 is situated over or offset to the plunger side of and is unengaged with opening 223. When a force is applied to retracting member 215 as shown in FIG. 3B to pull plunger 211 from its extended position into housing 213 against the force of the spring 225 toward a retracted position, locking member 222 moves past and remains unengaged with housing opening 223 so that plunger 211 is able to freely move within the housing to the retracted position. On the other hand, when a force is applied in an attempt to push plunger 211 from its extended position into the housing toward a retracted position as shown in FIG. 3C, the cylindrical pin cam member 219 acts against inclined slot cam follower 217 positively causing locking member 222 to protrude into housing opening 223 so that portion 231 on intermediate member 216 engages with an edge 232 on housing 213, thereby limiting movement of plunger 211 and preventing it from reaching the retracted position.

A safety latch 310 according to a fourth embodiment of the present invention is described with reference to FIGS. 4A through 4D. Many of the components of this fourth embodiment are the same as or similar to components of the first, second and third embodiments, and it is therefore unnecessary to repeat a description of those like components here. The fourth embodiment differs from the first three embodiments in terms of the specific configurations and interconnections of the intermediate member, the plunger and the retracting member. More particularly, safety latch 310 includes a substantially L-shaped intermediate member 316 that is pivotally connected to plunger 311 by means of a cylindrical pin 319 on the plunger inserted through a hole 317 on one end of the intermediate member. The other end of intermediate member 316 is slidably connected to retracting member 315 by means of a cylindrical pin 318 on the intermediate member extending through an inclined slot 320 on the retracting member. The intermediate member also includes a locking member 322 that is engageable with an opening 323 in the side of the housing 313.

Figure 4A:
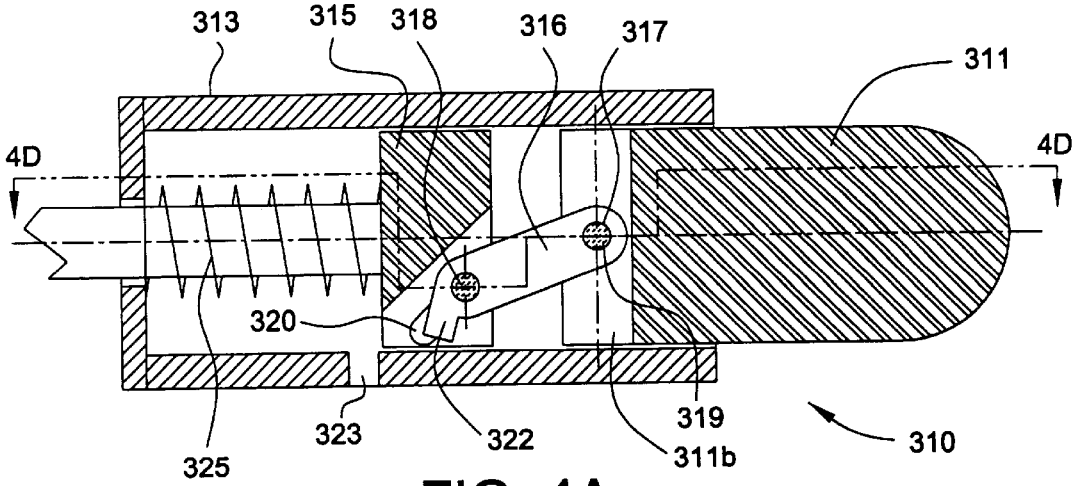
FIGS. 4A, 4B, 4C and 4D are views partially in cross section of a safety latch according to a fourth embodiment of the present invention.
Figure 4B:
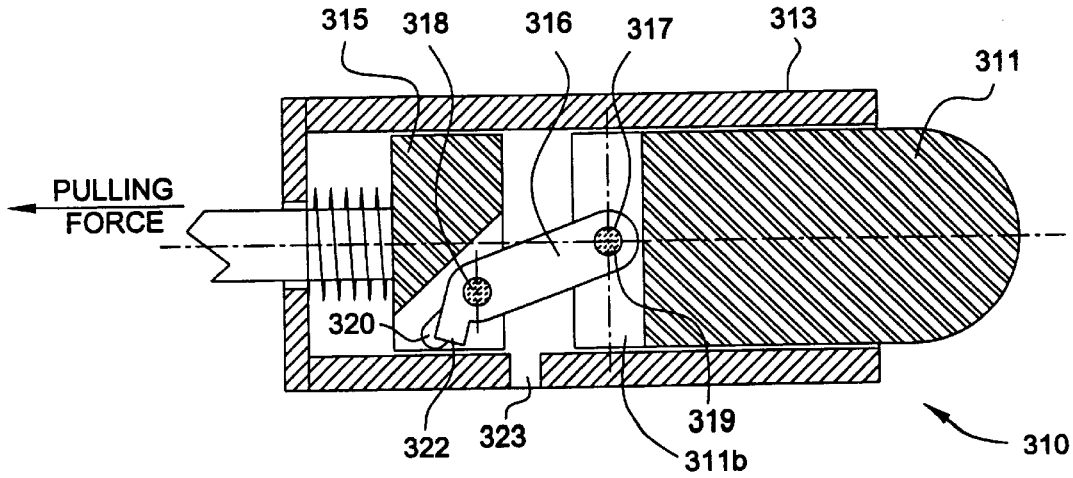
Figure 4C:
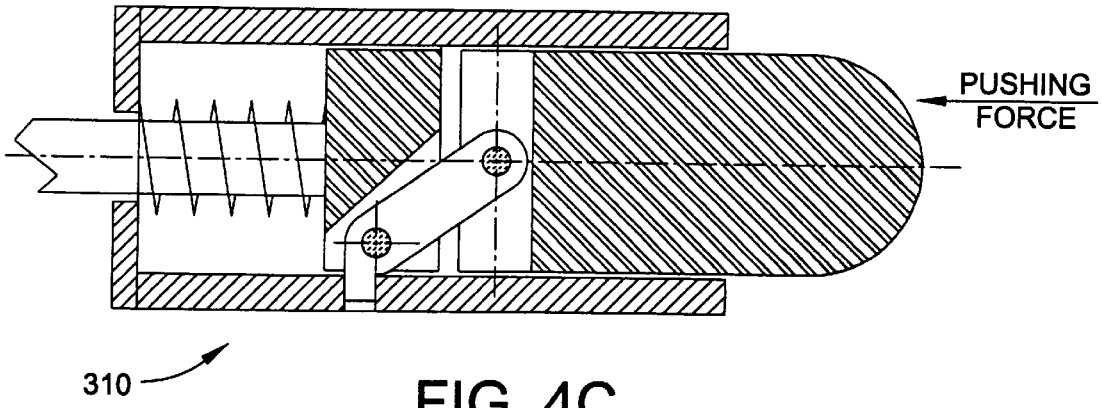
Figure 4D:
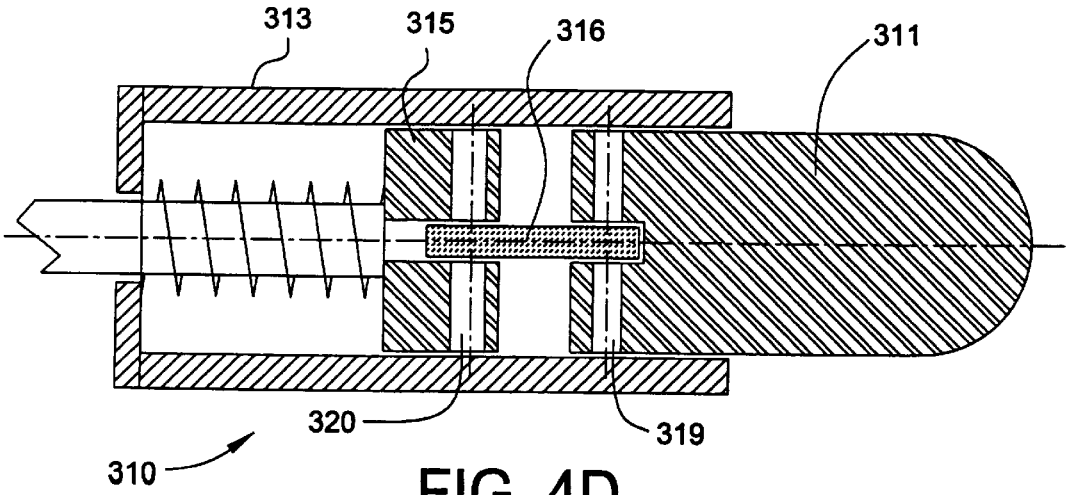

Plunger 311 and retracting member 315 may be machined for central positioning of intermediate member 316 within housing 313 as shown in FIG. 4D, or the plunger and retracting member may be machined for positioning of intermediate member 316 adjacent one of the walls of housing 313. In this fourth embodiment, since the intermediate member 316 is pivotally connected to plunger 311, it can be said that the inner end 311*b* of plunger 311 includes cylindrical pin cam member 318, although cam member 318 is not unitarily formed on or otherwise fixedly provided on end 311*b* of plunger 311. Inclined slot 320 on retracting member 315 serves as the cam follower.

The operation of the fourth safety latch embodiment is described with reference to FIGS. 4A through 4C. FIG. 4A illustrates safety latch 310 when plunger 311 is in an extended position and locking member 322 is situated over or offset to the plunger side of and is unengaged with opening 323. When a force is applied to retracting member 315 as shown in FIG. 4B to pull plunger 311 from its extended position into housing 313 against the force of the spring 325 toward a retracted position, locking member 322 moves past and remains unengaged with housing opening 323 so that plunger 311 is able to freely move within the housing to the retracted position. However, when a force is applied in an attempt to push plunger 311 from its extended position into the housing toward a retracted position as shown in FIG. 4C, cylindrical pin cam member 318 acts against inclined slot cam follower 320 positively causing locking member 322 to protrude into housing opening 323 so that portion 331 on intermediate member 316 engages with an edge 332 on housing 313, thereby limiting movement of plunger 311 and preventing it from reaching the retracted position.

Figure 5A:
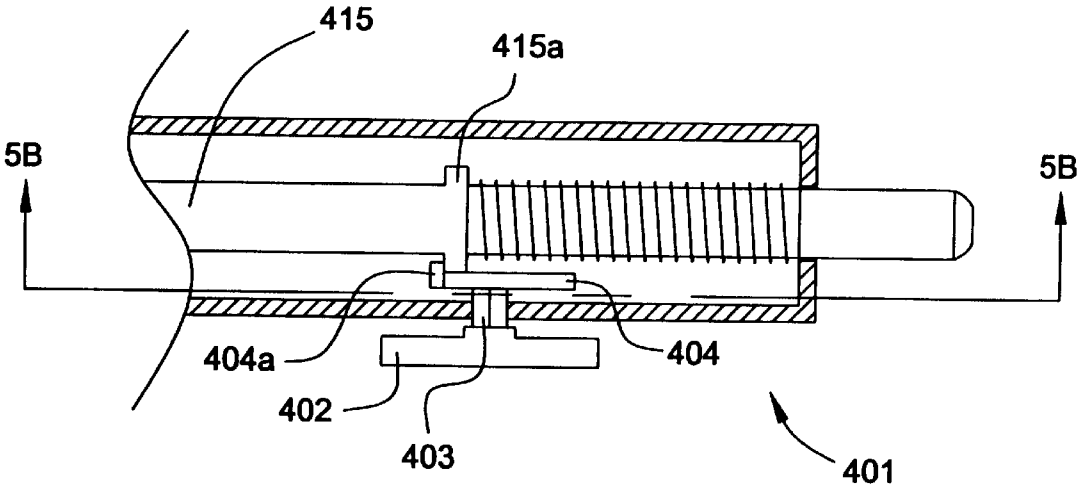
FIGS. 5A and 5B are views partially in cross section of an embodiment of a rotational mechanism according to the present invention for applying force to the retracting member.
Figure 5B:
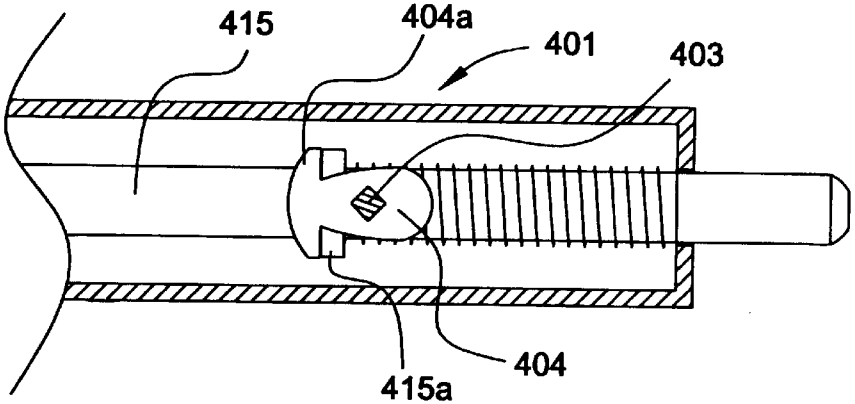

Each of the four safety latch embodiments described above has been depicted with an in-line mechanism for applying a force to the retracting member to pull the plunger toward a retracted position, namely a ring (e.g., ring 29) in conjunction with a protruding end of the retracting member (e.g., retracting member end 15*a*). As alternatively depicted in FIGS. 5A and 5B, a rotational mechanism 401 may instead be utilized for this purpose with any of the four safety latch embodiments. By way of example, a knurled knob 402 connected by a shaft 403 to a rotatable lever 404 may be used to impart translational force to retracting member 415. In this case, retracting member 415 includes an annular abutment element 415*a* that is engageable by a flange or flanges 404*a* on the lever 404. When knob 402 is rotated in either direction, a translational force is applied to the retracting member to pull the plunger (e.g., plunger 11) toward a retracted position. This rotational mechanism, as well as any of the described in-line mechanisms, may also be equipped with a conventional key-actuated or other locking mechanism to preclude unauthorized operation of the safety latch.

One possible application of any of the safety latches of the present invention is illustrated in FIG. 6. As shown by way of example, two safety latches 10 of the present invention—or any of the alternatively described and illustrated safety latches 110, 210, 310—are mounted on a hinged access panel 502 of a shipping container 501. The plungers 11 of the safety latches are engageable with recesses 503 in the access panel frame of the shipping container to secure the access panel. Through the use of the safety latches, the access panel can be easily opened by simultaneously pulling on rings 29 of safety latches 10 directly or by means of a connecting cable 504. At the same time, the safety latches 10 prevent inadvertent opening of the access panel by jarring impacts of the shipping container or otherwise. Moreover, the safety latches cannot be pried open by unauthorized persons attempting to forcibly enter the shipping container. Of course, authorized entry can be provided for by devising a special tool for engaging rings 29 or cable 504 through a hole in the top of the shipping container, by provision of key-actuated rotational mechanisms described above and accessible from outside the shipping container, or in other ways that will be appreciated by those skilled in the art reading this description.

While the present invention has been described in conjunction with specific embodiments, it is evident that many alternatives, modifications and variations will be apparent to those skilled in the art. For example, although the components of the various safety latch embodiments are illustrated with certain relative shapes and dimensions, a variety of shapes and dimensions are possible as will be readily apparent from the foregoing description. By way of further example, although in the various preferred embodiments illustrated and described the cam member acts against the cam follower to positively cause the locking member to engage with the housing so as to prevent the plunger from being pushed to the retracted position, it is also possible—although not as preferable—to arrange the cam member and cam follower such that a pulling force applied to the plunger causes the cam member and cam follower to disengage from the housing a locking member that is normally biased or otherwise held in engagement with the housing when the plunger is in an extended position. Accordingly, the preferred embodiments of the invention set forth above are intended to be illustrative, not limiting, and various changes may be made without departing from the spirit and scope of the invention as defined in the following claims.

What is claimed is:

1. A safety latch comprising:

a plunger movable between extended and retracted positions, a first end of the plunger being available for engagement;

a cam member interconnected with the plunger;

a cam follower acted against by the cam member in response to a first, pushing force being applied to the first end of the plunger in a direction from the extended position toward the retracted position;

a retracting member interconnected with the plunger such that the plunger is movable toward the retracted position in response to a second, pulling force being applied to the retracting member in said direction; and a locking member interconnected with the cam follower such that the cam member acting against the cam follower in response to the first force being applied to the first end of the plunger positively causes the locking member to engage with adjacent structure to prevent movement of the plunger to the retracted position;

whereby the plunger is movable from the extended position to the retracted position when the second force is applied to the retracting member to pull the plunger toward the retracted position, whereas when the first force is applied in an attempt to push the plunger from the extended position toward the retracted position the locking member is caused to engage with the adjacent structure to prevent movement of the plunger to the retracted position.

2. The safety latch of claim 1, a second end of the plunger including the cam member.

3. The safety latch of claim 1, further comprising a spring for biasing the plunger into the extended position, the retracting member acting against the biasing spring when the second force is applied to the retracting member.

4. The safety latch of claim 1, each of the cam member and the cam follower including an inclined surface.

5. The safety latch of claim 1, the cam member including a substantially cylindrical-shaped member and the cam follower including an inclined surface.

6. The safety latch of claim 1, the locking member and the cam member being positioned on an intermediate member that is located between the plunger and the retracting member and is connected to the plunger, and the cam follower being located on the retracting member.

7. The safety latch of claim 1, wherein the second force applied to the retracting member to pull the plunger toward the retracted position is applied by means of an in-link mechanism.

8. The safety latch of claim 1, wherein the second force applied to the retracting member to pull the plunger toward the retracted position is applied by means of a rotational mechanism.

9. The safety latch of claim 1, the locking member not being caused to engage with the adjacent structure in response to the second force being applied to the retracting member.

10. The safety latch of claim 1, the locking member being positioned on an intermediate member located between the plunger and the retracting member.

11. The safety latch of claim 10, the cam follower being positioned on the intermediate member.

12. The safety latch of claim 11, the plunger and the retracting member being connected to opposite ends of the intermediate member.

13. The safety latch of claim 12, the opposite ends of the intermediate member including protruding couplers for connection to corresponding receiving grooves on the plunger and the retracting member.

14. The safety latch of claim 12, one of the opposite ends of the intermediate member including a hole for pivotal connection to a cylindrical pin on the retracting member, and the other opposite end of the intermediate member including an inclined slot forming the cam follower for sliding connection to a cylindrical pin forming the cam member on the second end of the plunger.

15. The safety latch of claim 12, the intermediate member being substantially Z-shaped.

16. The safety latch of claim 12, the intermediate member being substantially L-shaped.

17. A safety latch comprising:

a housing;

a plunger slidably received within a first opening in the housing and movable between extended and retracted positions, a first end of the plunger being available for engagement externally of the housing and a second end of the plunger within the housing including a cam member;

a cam follower acted against by the cam member in response to a first, pushing force being applied to the first end of the plunger in a direction from the extended position toward the retracted position;

a retracting member interconnected with the plunger such that the plunger is movable toward the retracted position in response to a second, pulling force being applied to the retracting member in said direction; and a locking member interconnected with the cam follower and caused, by action of the cam member against the cam follower in response to the first force being applied to the first end of the plunger, to engage with the housing to prevent movement of the plunger to the retracted position, the locking member not being caused to engage with the housing in response to the second force being applied to the retracting member;

whereby the plunger is movable within the housing from the extended position to the retracted position when the second force is applied to the retracting member to pull the plunger into the housing toward the retracted position, whereas when the first force is applied in an attempt to push the plunger into the housing from the extended position toward the retracted position the locking member is caused to engage with the housing to prevent movement of the plunger to the retracted position.

18. The safety latch of claim 17, further comprising a spring for biasing the plunger into the extended position, the retracting member acting against the biasing spring when the second force is applied to the retracting member.

19. The safety latch of claim 17, each of the cam member and the cam follower including an inclined surface.

20. The safety latch of claim 17, the cam member including a substantially cylindrical-shaped pin and the cam follower including an inclined slot.

21. The safety latch of claim 17, the locking member and the cam member being positioned on an intermediate member that is located between the plunger and the retracting member and is connected to the plunger, and the cam follower being located on the retracting member.

22. The safety latch of claim 17, the locking member being positioned on an intermediate member located between the plunger and the retracting member.

23. The safety latch of claim 22, the cam follower being positioned on the intermediate member.

24. The safety latch of claim 22, the plunger and the retracting member being connected to opposite ends of the intermediate member.

25. The safety latch of claim 24, the opposite ends of the intermediate member including protruding couplers for connection to corresponding receiving grooves on the plunger and the retracting member.

26. The safety latch of claim 24, one of the opposite ends of the intermediate member including a hole for pivotal connection to a cylindrical pin on the retracting member, and the other opposite end of the intermediate member including an inclined slot forming the cam follower for sliding connection to a cylindrical pin forming the cam member on the second end of the plunger.

27. A safety latch comprising:

a housing;

a plunger slidably received within a first opening in the housing and movable between extended and retracted positions, a first end of the plunger being available for engagement externally of the housing and a second end of the plunger within the housing including a cam member;

a retracting member interconnected with the plunger such that the plunger is movable toward the retracted position in response to a first, pulling force being applied to the retracting member in a direction from the extended position toward the retracted position;

an intermediate member located between the plunger and the retracting member, the intermediate member including a cam follower acted against by the cam member in response to a second, pushing force being applied to the first end of the plunger in said direction, the intermediate member further including a locking member caused, by action of the cam member against the cam follower in response to the second force being applied to the first end of the plunger, to engage with the housing to prevent movement of the plunger to the retracted position, the locking member not being caused to engage with the housing in response to the first force being applied to the retracting member; and a spring acting against the housing to bias the plunger into the extended position, the retracting member acting against the spring when the first force is applied to the retracting member;

whereby the plunger is movable within the housing from the extended position to the retracted position when the first force is applied to the retracting member to pull the plunger into the housing toward the retracted position, whereas when the second force is applied in an attempt to push the plunger into the housing from the extended position toward the retracted position the locking member is caused to engage with the housing to prevent movement of the plunger to the retracted position.

28. A safety latch comprising:

a plunger movable between extended and retracted positions, a first end of the plunger being available for engagement and a second end of the plunger including a cam member;

a cam follower acted against by the cam member in response to a first, pushing force being applied to the first end of the plunger in a direction from the extended position toward the retracted position;

a retracting member interconnected with the plunger such that the plunger is movable toward the retracted position in response to a second, pulling force being applied to the retracting member in said direction; and a locking member interconnected with the cam follower and caused, by action of the cam member against the cam follower in response to the first force being applied to the first end of the plunger, to engage with adjacent structure to prevent movement of the plunger to the retracted position;

whereby the plunger is movable from the extended position to the retracted position when the second force is applied to the retracting member to pull the plunger toward the retracted position, whereas when the first force is applied in an attempt to push the plunger from the extended position toward the retracted position the locking member is caused to engage with the adjacent structure to prevent movement of the plunger to the retracted position.

* * * * *